US008963445B2

(12) United States Patent
Baccarin et al.

(10) Patent No.: US 8,963,445 B2
(45) Date of Patent: Feb. 24, 2015

(54) DRIVER CIRCUIT OF LIGHT SOURCES

(71) Applicant: Automotive Lighting Italia S.p.A. a Socio Unico, Venaria Reale, Turin (IT)

(72) Inventors: Davide Baccarin, Turin (IT); Andrea Englaro, Turin (IT)

(73) Assignee: Automotive Lighting Italia S.p.A., Turin (IT)

( * ) Notice: Subject to any disclaimer, the term of this patent is extended or adjusted under 35 U.S.C. 154(b) by 16 days.

(21) Appl. No.: 14/018,708

(22) Filed: Sep. 5, 2013

(65) Prior Publication Data

US 2014/0103802 A1 Apr. 17, 2014

(30) Foreign Application Priority Data

Sep. 7, 2012 (IT) ..... PD2012A0260

(51) Int. Cl.
*H05B 37/02* (2006.01)
*H05B 33/08* (2006.01)

(52) U.S. Cl.
CPC ..... *H05B 33/0845* (2013.01); *H05B 33/0821* (2013.01); *H05B 33/089* (2013.01)
USPC ..... 315/291; 315/85; 315/294; 315/307; 315/224; 307/10.1; 307/10.8

(58) Field of Classification Search
USPC ..... 315/85 R, 294, 291, 224, 246, 307, 308; 307/10.1, 10.8
See application file for complete search history.

(56) References Cited

U.S. PATENT DOCUMENTS

| | | | | |
|---|---|---|---|---|
| 5,861,729 | A * | 1/1999 | Maeda et al. | 320/106 |
| 6,281,991 | B1 * | 8/2001 | Mori et al. | 358/475 |
| 6,400,101 | B1 * | 6/2002 | Biebl et al. | 315/291 |
| 6,732,534 | B2 * | 5/2004 | Spry | 62/3.7 |
| 8,519,632 | B2 * | 8/2013 | Krespach et al. | 315/291 |
| 2004/0090189 | A1 * | 5/2004 | Yoneda et al. | 315/291 |
| 2011/0037401 | A1 * | 2/2011 | Yu | 315/246 |
| 2011/0133645 | A1 * | 6/2011 | Kuo et al. | 315/77 |
| 2011/0210675 | A1 * | 9/2011 | Hamamoto et al. | 315/185 R |
| 2014/0103802 | A1 * | 4/2014 | Baccarin et al. | 315/77 |
| 2014/0159576 | A1 * | 6/2014 | Marchesin et al. | 315/77 |

FOREIGN PATENT DOCUMENTS

EP 1 411 750 A2 4/2004

* cited by examiner

*Primary Examiner* — Thuy Vinh Tran
*Assistant Examiner* — Syed M Kaiser
(74) *Attorney, Agent, or Firm* — Howard & Howard Attorneys PLLC

(57) ABSTRACT

The invention relates to a driver circuit for light sources, in particular LEDs, comprising a selection circuit, comprising at least one selection circuit element defined by an electric quantity having one of a plurality of pre-established electric quantity levels, and an electronic control unit (ECU), comprising a reference circuit, suitable for providing a reference electric quantity, and a regulation circuit of the driver current, suitable for establishing a driver current of the light sources on the basis of said reference electric quantity.

16 Claims, 7 Drawing Sheets

| CTRL 1 | CTRL 2 | $R_{EQ}$ | STATO |
|---|---|---|---|
| 0 | 0 | ∞ | S1 |
| 1 | 0 | $R_2$ | S2 |
| 1 | 1 | $R_1 / R_2$ | S3 |

Fig. 4

DRIVER CIRCUIT OF LIGHT SOURCES

BACKGROUND OF INVENTION

1. Field of the Invention

The present invention relates to a current-regulated driver circuit for light sources, in particular LED light sources.

2. Description of the Related Art

Such circuits typically include LED light sources and an electronic control unit (ECU) suitable for regulating a driver current absorbed by the LED light sources, which may be arranged in LED strings or matrixes. More specifically, the electronic control unit includes a reference circuit of an electric quantity and a regulation circuit of the driver current. The reference circuit of an electric quantity provides a reference of an electric quantity, such as a reference voltage $V_{ref}$; the current regulation circuit imposes a specific driver current on the light sources, on the basis of the reference of the electric quantity provided by the reference circuit of electric quantity and on the value of an electric resistor known in the art as a bin resistor. In some applications, for example in LED lighting for vehicle lights, the electronic control unit and LED light sources are generally placed on separate electronic circuit boards.

Such LED light sources however are supplied by the manufacturers and are grouped in lots according to different luminous flow selections (or binning. The LEDs from each, when driven at nominal voltage and/or current values, emit a variable luminous flow only within a specific and limited predefined range. As a result, a light of a first vehicle light, such as the right light, may be made with a lot of LEDs having a first flow selection mounted on a first LED circuit board, while a second vehicle light, such as the left light, may be made with a second lot of LEDs having a second flow selection. Obviously, such same light, whether of the first or second vehicle light, such as for example a brake light, side light, fog light, reverse light, indicator light, dipped beam headlight, full beam headlight or the like, must emit the same luminous flow regardless of the LED lot used. The same consideration applies to vehicle lights installed on different, similar models of vehicle. In practice, the light manufacturer chooses the lot with the lowest flow selection for a light and limits the luminous flows of the LEDs of the other lights to emitting the same luminous flow, reducing the power supply current on the basis of information generally provided by the bin resistor value.

In one embodiment frequently used in the related art, the driver circuit of light sources has the configuration represented schematically in FIG. 1, which shows the bin resistor (RBIN) mounted on the LED circuit board and connected to the electronic control unit (ECU) mounted on another circuit board.

One drawback of this circuit is the need to position and connect two cables (W1, W2) to detect the current on the bin resistor. Moreover, since the bin resistor is on the LED circuit board and the electronic control unit is on another circuit board, the connection cables and connectors introduced may give rise to problems of electromagnetic compatibility. For the same reason, the feedback loop of the current regulation module of the ECU may become unstable on account of the onset of capacitive and inductive components introduced by the connection of the two cables W1 and W2. In fact, the voltage drop on the bin resistor is a modest value, so that even the smallest disturbance may significantly influence the total current flowing in the LEDs. Moreover, given that the bin resistor value Rbin is relatively small, relatively small impedance values introduced by the connections of the cables W1, W2 may significantly influence the total current flowing in the LEDs.

The transmission line between the LED terminal strip and electronic control unit can cause a variation in the current flowing in the LEDs. If the bin resistor must stay on the LED terminal strip and is connected to ground and to the feedback circuit by a transmission circuit, such transmission circuit introduces parasitic resistive, inductive, and capacitive elements. The resistance component is created by the connectors of the two electronic circuit boards and by the resistance of the connector cables between the circuit boards. Moreover, oxidation of the connectors also causes a variation in their resistance. The capacitive and inductive components are related to the length of the cables, which may pick up disturbances coming from the outside environment. Such electromagnetic disturbances may be identified as a voltage variation $\Delta V_{EMC}$. Such voltage variation, to the order of mill volts, thus depends solely on external conditions and is introduced on the bin resistor line.

Consequently, while on the emitter of the driver transistor there is a fixed reference voltage $V_{ref}$, on the bin resistor there is the reference voltage $V_{ref}$ plus the disturbance $\Delta V_{EMC}$. So, the bin resistor current, $I_{RBIN}$, and therefore the current flowing in the LEDs, $I_{LED}$, is given by $(V_{ref}+\Delta V_{EMC})/R_{BIN}$. Considering also the contribution of the resistance of the connectors $R_T$, one has:

$$I_{LED}=(V_{ref}+\Delta V_{EMC})/(R_{BIN}+R_T).$$

So, $I_{LED}$ no longer depends solely on $V_{ref}$ and on $R_{BIN}$, but on $V_{ref}$, $\Delta V_{EMC}$ and $R_T$. With a $V_{ref}$ for example of 0.5 V, even small disturbances significantly influence the $I_{LED}$. Even the bin resistor, typically to the order of 1-10 ohm, is influenced by the connector resistance, for example due to the oxidation of the connectors.

In addition, as the above, the reactive components LC introduced in the feedback loop may cause instability and the oscillation of the feedback circuit.

Published EP patent application No. EP1411750A2 describes a power supply circuit of an LED lighting unit which uses an identification resistor having a resistance corresponding to the characteristics of the LED circuit. In one embodiment, the power supply circuit includes an identification portion which measures the resistance of the identification resistor included in the LED circuit, determines which range the resistance measured belongs to, and provides in output a classification signal based on such determination. A circuit control portion of the constant current receives the classification signal, establishes a maximum admissible current depending on such classification signal and provides a driver current to the LED circuit proportional to a predefined current value within the maximum admissible value.

In the embodiment, the identification resistor has a terminal connected to a constant voltage power supply generator. The range which the resistance of the identification resistor belongs to is determined by comparing, by a plurality of comparators, the voltage on the other terminal of the resistor with a plurality of constant voltage references.

Such circuit performing comparison of the voltage values is not however immune from electromagnetic disturbances and requires a constant power supply generator to connect the identification resistor to. For example, an electromagnetic disturbance which is propagated along the cable connecting the identification resistor and the voltage comparison circuit could easily cause an alteration of the voltages to be compared and thus cause an error in the determination of the range of resistance values.

Consequently, the circuit described in EP1411750A2 is not suitable for applying in situations, such as in the case of a vehicle light, where the power supply voltage is highly variable and where significant electromagnetic disturbances are present. It is to be noted, for example, that the driver circuit of a vehicle light is powered by a battery and by an alternator which provides a power supply voltage varying from 7-8 volts and 17-18 volts, depending on the application.

SUMMARY OF THE INVENTION

The present invention relates to a driver circuit for light sources, in particular LEDs, which makes it possible to drive different light sources, for example differing in the luminous flow generated for the same power supply voltage or current, while keeping the electronic control unit unaltered.

In the field of vehicle lights, in which the light sources, in particular LEDs, are situated on an electronic circuit board or on a terminal strip, and the electronic control unit is placed on a different circuit board, the driver circuit as set forth in the invention sets out to make an electronic control circuit board suitable for commanding various terminal strips containing the light sources.

These objects are achieved by a driver circuit, by an electronic control circuit board, and by a driver method as described in greater detail below.

BRIEF DESCRIPTION OF THE DRAWINGS

Further characteristics and advantages of the invention will be more clearly comprehensible from the description given below with reference to the appended drawings, wherein:

FIG. 4 is a table of the states which the driver circuit according to the invention;

DETAILED DESCRIPTION

The term "connected" refers both to a direct electrical connection between two circuits or circuit elements and to an indirect connection by one or more active or passive intermediate elements. The term "circuit" may indicate either a single component or a plurality of components, active for passive, connected to each other to achieve a predefined function. Moreover, where a bipolar junction transistor (BJT) or a field effect transistor (FET) can be used, the meaning of the terms "base," "collector," and "emitter," include the terms "gate," "drain," and "source," and vice versa. Except as is otherwise indicated, NPN-type transistors may be used in place of PNP-type transistors, and vice versa.

Figure 2:
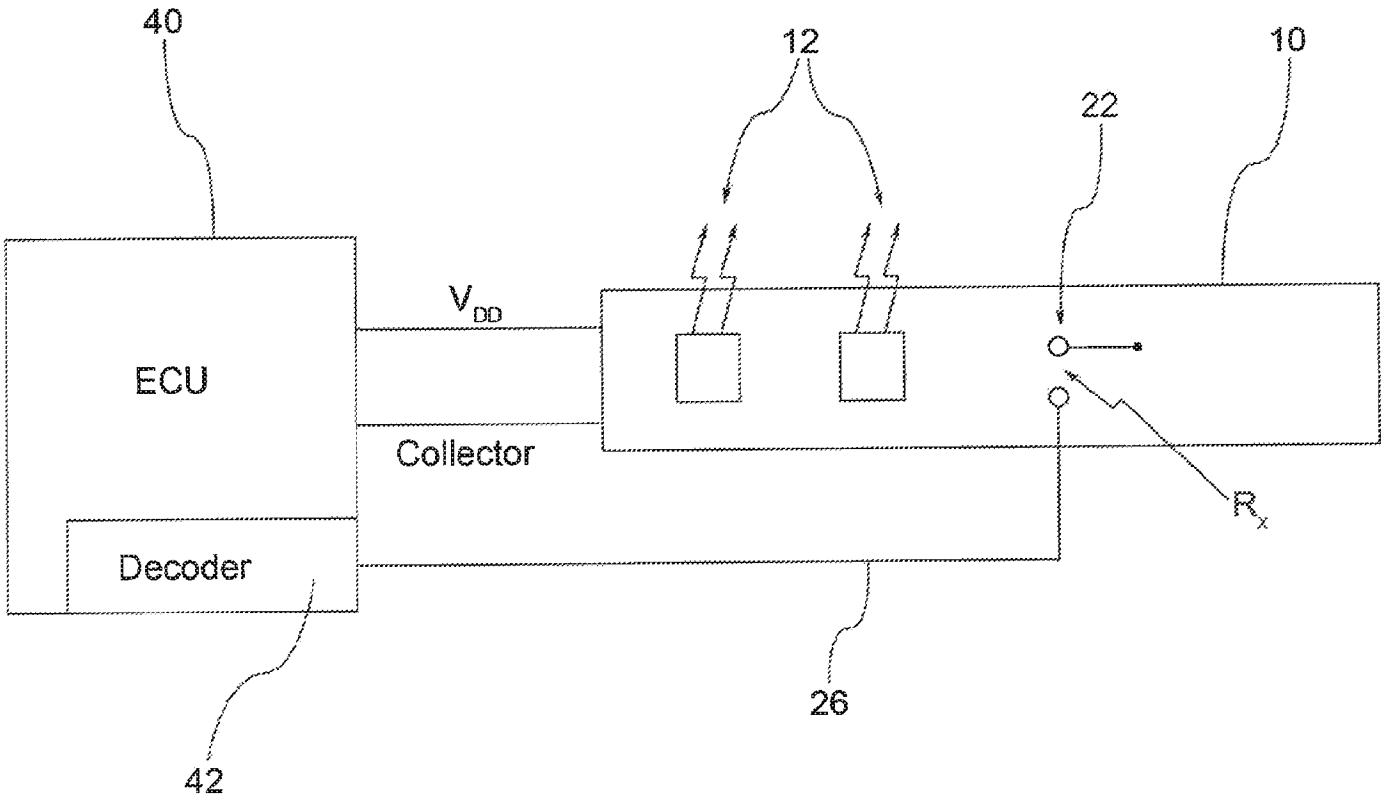
FIG. 2 is a block diagram of the driver circuit according to the invention.

The driver circuit according to the invention is shown in the diagram in FIG. 2, showing a lighting terminal strip 10 containing a plurality of light sources 12 such as LEDs, and an electronic control unit (ECU) 40, comprising a reference circuit, for providing a reference electric quantity, such as a reference voltage $V_{ref}$, and a regulation circuit of the driver current, that establishes a driver current of the light sources on the basis of the reference electric quantity.

For the purposes of clarity and according to the examples illustrated, reference will be made to the electric voltage ($V_{ref}$) as one example of a reference electric quantity. It is clear to a person skilled in the art that, depending on requirements and on the type of control unit used, the reference voltage may be replaced with a current, a resistor, or another electric quantity.

The lighting terminal strip 10 includes a selection circuit 22, comprising at least one selection circuit element Rx defined by an electric quantity having one of a plurality of pre-established electric quantity levels. The selection circuit 22 identifies one lighting terminal strip from a plurality of different lighting terminal strips, differing from each other in the characteristics of the light sources, such as the luminous flow.

The electronic control unit 40 includes a terminal strip identification block 42, called "decoder," that receives an electric signal coming from the selection circuit 22, "decoding" the electric signal, (identifying the level of the electric quantity which characterises the selection circuit, and thus identify the lighting terminal strip 10), and supplying the current regulation circuit with the right reference voltage value $V_{ref}$ for that lighting terminal strip.

Consequently, instead of using an analogue signal, such as the current on the resistor bin to define the driver current of the LEDs, a discrete signal is used in several states (for example: three states). The states correspond to the same number of driver current levels of the LEDs. If appropriately distanced from each other, as described below, the states make the driver circuit immune from the disturbances defined above.

In one embodiment, the selection circuit element Rx of the selection circuit 22 is a resistor element having one terminal connected to the power supply voltage $V_{DD}$ and the other terminal connected to an input of the terminal strip identification block 42 by a cable 26. The electric quantity characterising the selection circuit 22 is thus an electric resistor.

The same electronic circuit board containing the ECU may thus be used to control a large number of different lighting terminal strips 10, in which different lots of LEDs are respectively installed.

Reference will now be made to the vehicle light LED sector, where LEDs with three different luminous flows for the same driver current or voltage are normally used, and thus three different lighting terminal strips 10 may be had.

In the example relative to vehicle lights with three different levels of luminous flow, in one embodiment, the selection circuit is either a short-circuit (Rx=0), an open-circuit (Rx=∞), or a medium-impedance-circuit (for example: Rx=10 kΩ). Consequently, the selection circuit 22 may assume one of three possible states, to which the same number of lighting terminal trips 10 correspond relative to one lot of LEDs. For example, the open-circuit corresponds to a state S1, the short-circuit to a state S2, and the medium-impedance-circuit to a state S3.

It is to be noted that, despite it being advantageous from a production point of view to make a selection circuit with two terminals which can be left disconnected (open-circuit), or connected in short-circuit, or connected by an electric resistor (medium-impedance-circuit), the term "short-circuit" also includes very low-resistance values compared to a medium-impedance value (which is, for example, chosen so as to generate a voltage drop at the ends of the selection resistor element equal to about half the value of the power supply voltage $V_{DD}$) and the term "open-circuit" also includes very high-resistance values compared to the medium-impedance value The "decoder" block 42 receives the voltage drop Vx in input on the selection resistor element Rx and provides in output, depending on the voltage drop Vx, one of three possible reference voltage values $T_{ref}$. The three reference voltage values are predefined values, each chosen optimally on the basis of the characteristics of the LEDs, such as the luminous flow.

Advantageously, any disturbances altering the value of the voltage drop on the resistor element have no effect, in that the circuit is scaled so that such disturbances do not change the state of the circuit, which is implemented at discrete levels. In addition, the circuit needs only one cable 26 instead of two, resulting in an obvious reduction of costs, assembly times, and exposure to electromagnetic disturbance.

The selection circuit 22 is very easy to make starting from a lighting terminal strip 10. It is, in fact, sufficient to provide two terminals which can be left disconnected (open-circuit), or connected in short-circuit, or connected by an electric resistor (medium-impedance-circuit).

It is to be noted that the discrete signal supplied by the section circuit is not a binary, but a multilevel signal. In other words, to obtain three states with a digital solution two bits would be needed. Thus two cables are required, and with the multilevel solution according to the invention, three states can be obtained with a single cable 26, as described below in greater detail.

It is to be emphasised that, while in the prior art the driver circuit of light sources is provided with a circuit that can be operated to vary the current flowing in the LEDs, in the present invention, and specifically the decoder block, an embodiment of which is described below, can be operated to identify the states to which the same number of separate driver current levels correspond. The driver current thus derives from the measurement of an impedance, which may be for example a short-circuit, an open-circuit, or a medium-impedance-circuit. Several clearly identified and distant states are thus obtained which cannot vary like an analogue signal, which is characteristic of a conventional driver circuit. In other words, the concept of a multilevel digital signal has been applied to an LED driver circuit.

One possible embodiment of the decoder block 42 for the identification of the three levels will now be described. The decoder block includes a levels acquisition circuit 50 and a levels definition circuit 60. The levels acquisition circuit 50 acquires at least one electric selection signal associated with the level of the electric quantity of the selection circuit element Rx and providing selection information relative to the level of electric quantity. The levels definition circuit 60 receives the selection information and provides, in response to the selection information, a reference voltage $V_{ref}$ from a plurality of predefined reference voltage levels.

In particular, the levels acquisition circuit 50 has a number of output terminals Ctr11, Ctr12 depending on the number of levels which the electrical quantity of the selection circuit element can assume. For example, in the case of the three levels discussed previously, the levels acquisition circuit 50 has two output terminals Ctr11 and Ctr12. Because each output terminal CTr11 and Ctr12 can assume two values, four levels can be obtained from the combination of the possible values of two output terminals. For example, each output terminal can be connected to ground or is suitable to assume a level of high impedance depending on the level of the electric selection signal in input to the levels acquisition circuit 50.

In one embodiment, the levels acquisition circuit 50 includes two level acquisition transistors Q11, Q10, the on or off state of which depends on the selection resistor level Rx, and two current-controlled output switches Q9, Q8, each controlled by a respective level acquisition transistor and having an output terminal Ctr11, Ctr12 connected to the levels definition circuit 60.

Figure 3:
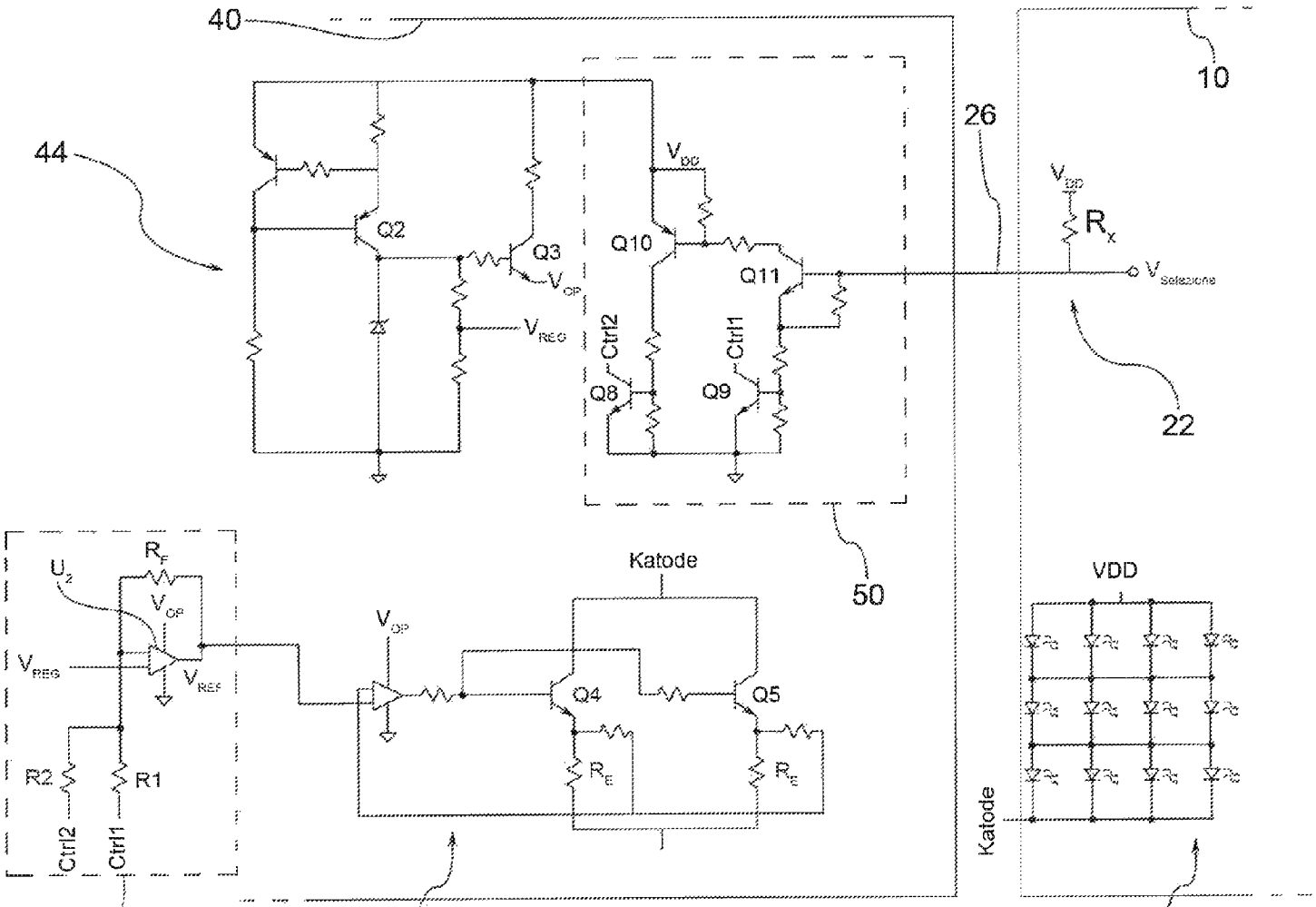
FIG. 3 is a circuit diagram of the driver circuit according to one embodiment of the invention.

More specifically, in the embodiment illustrated in FIG. 3, the levels acquisition circuit 50 is a transistor circuit connected between the power supply voltage $V_{DD}$ and the ground. A first transistor Q11 (level acquisition transistor) has the base connected to the selection circuit 22 of the terminal strip 10. For example, the base is connected to the power supply voltage $V_{DD}$ by the selection resistor element Rx, which may be a short-circuit, an open circuit or a medium impedance resistor. The emitter of the first transistor Q11 is connected by of a voltage divider to the base of a second transistor Q9 (current controlled switch), the emitter of which is connected to ground and the collector Ctr11 of which represents an output terminal of the levels acquisition circuit. The collector of the first transistor Q11 is connected, by a resistive divider, to the base of a third transistor Q10 (level acquisition transistor), the emitter of which is connected to the power supply voltage $V_{DD}$. The collector of the third transistor Q10 is connected, by a voltage divider, to the base of a fourth transistor Q8 (current controlled switch), the emitter of which is connected to ground. The collector of the fourth transistor Q8 represents the second output terminal Ctr12 of the levels acquisition circuit.

If the resistive selection element Rx is a short-circuit (Rx=0), the voltage at the base of the first transistor Q11 is the power supply voltage $V_{DD}$. The first and the second transistor Q11 and Q9 are therefore on. The first transistor Q11 does not have a sufficient collector voltage to turn on the third transistor Q10, which remains off, as does the fourth transistor Q8. Consequently, the first output terminal Ctr11 is grounded, while the second output terminal Ctr12 is in high-impedance.

It is to be noted that, being kept at the value of the power supply voltage $V_{DD}$ by a short-circuit, the base voltage of the first transistor Q11 is highly immune to the various types of disturbance and/or oscillations of the value of the power supply voltage $V_{DD}$.

If the resistive selection element is an open-circuit (Rx=∞), the first transistor Q11 is off in that its base is connected to ground by the pull-down stage R22, R29, R28. The first transistor being off, the other three are also off. Consequently, the two output terminals CTr11 and CTr12 are both in high impedance.

It is to be noted that, a disturbance in input to the levels acquisition circuit or a variation of the power supply voltage $V_{DD}$ is unlikely to have sufficient energy to be able to increase the base voltage of the first transistor Q11 to a value sufficient to be able to turn it on, also on account of the fact that the base voltage is not included in any conductive path between the power supply voltage $V_{DD}$ and ground.

If the resistive selection element Rx is a medium-impedance-circuit (for example: 10 kΩ), the voltage at the base of the first transistor Q11 is approximately equal to half the power supply voltage $V_{DD}$. In this case, not only is the second transistor Q9 on, but so are the third and fourth. Consequently, the two output terminals CTr11 and CTr12 are both connected to ground. Being polarised in conditions very distant from the off situation, the level acquisition transistors Q11 and Q10 are very unlikely to be turned off by disturbances or by oscillations of the power supply voltage $V_{DD}$. In fact, the circuit continues to function in this state even with variations in Rx to many orders of magnitude.

In one embodiment, the levels definition circuit 60 includes an operational amplifier circuit U2, where the operational amplifier U2 has a non-inverting input terminal connected to the output terminal of a generator circuit 44 of a regulated constant voltage $V_{reg}$, an output terminal which the reference voltage $V_{ref}$ is present on, connected to the input of the regulation circuit of the driver current 80, and a gain A which depends on the level of the selection information. Each output terminal Ctr11, Ctr12 of the levels acquisition circuit is connected to an input resistor R1, R2 connected to the inverting input of the operational amplifier. More specifically, if $R_F$ is a feedback resistor of the operational amplifier U2 and $R_{EQ}$ is the equivalent resistor defined as the resistor which connects the non-inverting input of the ground amplifier, then:

$$V_{ref}=V_{reg}*(1+R_F/R_{EQ})$$

Consequently, the gain A of the non-inverting operational amplifier is given by $1+R_F/R_{EQ}$, where $R_{EQ}$ depends on the control signals Ctr11 and Ctr12.

With reference to the table illustrated in FIG. 4, where the state of high impedance of the output terminals Ctr11, Ctr12 of the levels acquisition circuit is indicated by "0" and the ground connection of the output terminals by "1", a first state S1 may be defined in the presence of the combination "00" of the control signal on the output terminals Ctr11, Ctr12, given by the resistive selection element in open-circuit (Rx=∞), to which a first gain A1 of the amplifier equal to 1 corresponds. A second state S2 identified by the levels definition circuit may be defined by the combination "10" of the control signals on the output terminals Ctr11, Ctr12, given by the resistive selection element in short-circuit (Rx=0), to which a second gain A2 of the amplifier equal to (1+RF/R2) corresponds. A third state S3 identified by the levels definition circuit may be defined by the combination "11" of the control signals on the output terminals Ctr11, Ctr12, given by the resistive selection element in medium impedance (for example Rx=10 kΩ), to which a third gain A3 of the amplifier corresponds, equal to:

$$1+\frac{R_F}{R_{EQ}}=1+R_F\cdot\frac{R_1+R_2}{R_1\cdot R_2}$$

For example, if $R_F$=0.68 kΩ, R1=2.2 kΩ and R2=2.7 kΩ, the three different gain levels of the operational amplifier are: A1=1, A2=1.25 and A3=1.56.

To the three different gain values three reference voltage values $V_{ref}$ ($V_{ref1}$, $V_{ref2}$ e $V_{ref3}$) and thus three LED driver current values ($I_{LED1}$, $I_{LED2}$, $I_{LED3}$), correspond, given by: $I_{LED}=V_{refi}/R_E$, where $R_E$ is the resistor in series with the emitter of the driver transistor or transistors Q4, Q5 of the driver current regulation circuit 80, which powers the LED string or matrix 12.

A regulated voltage $V_{reg}$ is applied at the non-inverting input of the operational amplifier U2 of the levels definition circuit 60, which is free of disturbances defined above inasmuch as generated internally to the ECU, for example with a Zener diode D3.

Figure 1:
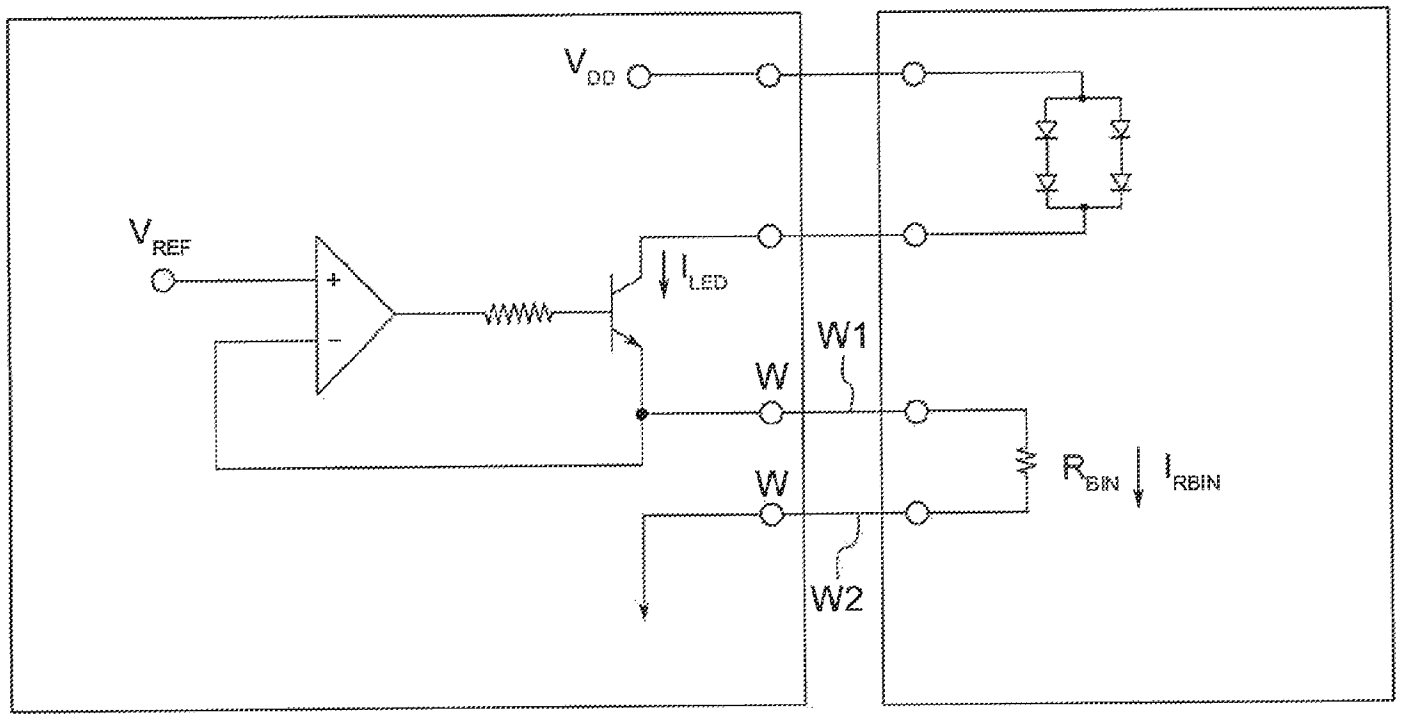
FIG. 1 is a diagram of an LED driver circuit according to the prior art.

It is to be noted that the emitter resistor $R_E$, in series with the emitter of the driver transistor Q4, Q5 of the LED string, or matrix 12, is no longer a bin resistor (a resistor chosen on the basis of the LED binning that is to say on the basis of the luminous flow which in the prior art illustrated in FIG. 1 was situated on the lighting terminal strip). Conversely, it is a fixed value resistor, regardless of the characteristics of the light sources. In the circuit of the present invention, the measurement on the lighting terminal strip 10 is performed by an additional selection circuit 22, in particular an additional resistor (Rx), which may assume a plurality of predefined values, which may be arbitrarily selected so as to be immune from disturbances or temperature variations. On the basis of the predefined values, the levels acquisition circuit generates the control signals Ctr11, Ctr12, which in turn determine different levels of the reference voltage $V_{ref}$.

It is important to emphasise how immunity from disturbances which could be picked up is achieved, for example, by the connection cable between the selection circuit on the lighting terminal trip and the decoder block on the ECU circuit board. By appropriately choosing the resistors R1, R2 which define the gain of the operational amplifier U2 of the levels definition circuit 60, it is possible to determine the variation of the $V_{ref}$ depending on the various configurations of the control signals Ctr11, Ctr12.

For example, in the of a vehicle light sector, as the luminous flow of the LEDs varies, each step of flow binning must be provided for by a current increase of 25%. With the values of the resistors of the levels definition circuit hypothesised above, an increase is in effect achieved of 25% to 56% of the gain, compared to the lowest value of 1.

As regards the immunity of the control signals Ctr11, Ctr12 from disturbances, the levels acquisition circuit has an input voltage, at the base of the first transistor Q11, indicated by $V_{selection}$ in FIG. 3, which substantially varies on three levels, from the power supply voltage $V_{DD}$ to ground. In particular, if the selection resistor Rx is a short-circuit, the input voltage is equal to the power supply voltage $V_{DD}$; if Rx is an open-circuit, the input voltage is zero; if the selection resistor Rx is a medium-impedance-circuit, the input voltage assumes an intermediate value between the power supply voltage $V_{DD}$ and the ground (for example: $V_{DD}/2$).

The advantage of making the levels acquisition circuit 50 work at functioning intervals delimited by the different values assumed by the input voltage $V_{selection}$, is that if a disturbance $\Delta V_{EMC}$ is generated, for example, due to the connection cable between the selection circuit and the levels acquisition circuit, such disturbance is not of an amplitude such as to make the input voltage $V_{selection}$ leave the state defined by the selection circuit element (Rx). It is clear, therefore, that if the input voltage $V_{selection}$ can assume a plurality of states or levels appropriately distanced from each other, any disturbances which should alter the input voltage will not translate into a variation in the power supply current of the LEDs.

Thus, the levels acquisition circuit measures the voltage drop at the ends of the selection circuit element Rx, which may also be affected by disturbances and thus vary. However, if the disturbances are inferior to the amplitude of the voltage interval separating two adjacent levels of the voltage input $V_{selection}$, the gain of the operational amplifier of the levels definition circuit corresponding to an input voltage does not vary and therefore the driver current of the LEDs does not vary either.

The driver circuit according to the invention has been described so far and represented in particular for the application to vehicle lights, where three selections of luminous flow and thus three lighting terminal strips are provided for. As mentioned above, it is clear that the idea which the present invention is based on may be extended to a much greater number of levels, so that the same electronic circuit board containing the ECU may be used to control a large number of different lighting terminal strips 10, in which different types as well as lots of LEDs are respectively installed.

The number of levels may be defined by assigning to a selection circuit element a plurality of levels of the electric quantity characterising it, and/or a selection circuit which includes more than one selection circuit element, which in turn may assume at least two different values.

Figure 5:
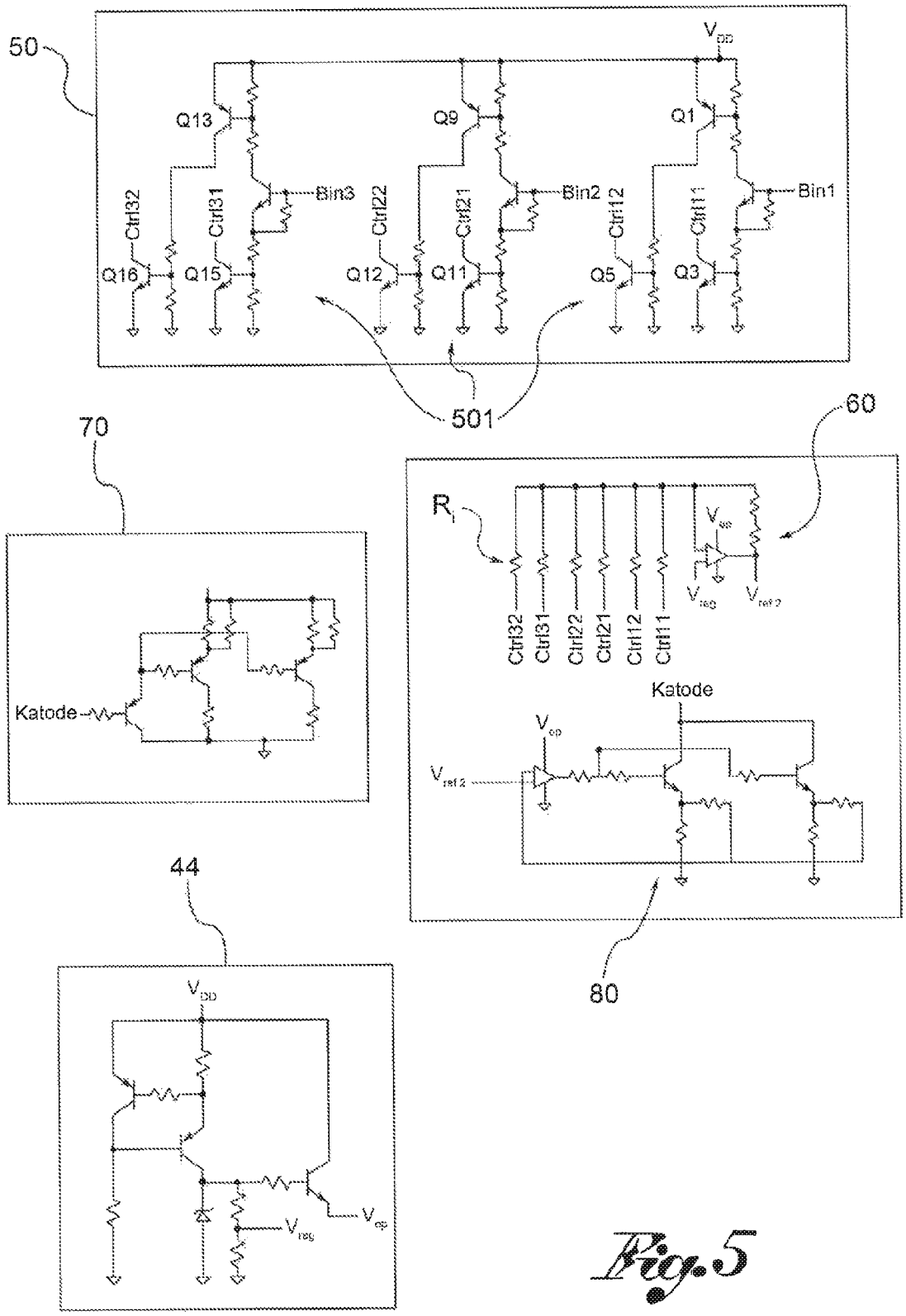
FIG. 5 is a circuit diagram of an electronic control circuit board of the driver circuit according to one embodiment of the invention.

In the example shown in FIG. 5, each lighting terminal strip includes three selection circuit elements Bin1, Bin2, Bin3. Each of these may assume for example the three levels mentioned above, that is short-circuit, open circuit or medium impedance. Consequently, $3^3$=27 different combinations are possible of the input voltage to the levels acquisition circuit 50, which is composed for example of three identical modules 501, each comprising the circuit with four transistors described above for the case of the three levels. Each module i has two output terminals to which the control signals Ctrli1, Ctrli2 are associated. The circuit is thus able to provide six control signals, by which it is possible to achieve the 27 states or levels for the levels definition circuit 60. The latter is analogous to the circuit described above where, in place of the two input resistors R1 and R2, there are six input resistors Ri. The levels definition circuit 60 is thus suitable to generate 27 different reference voltage levels and thus 27 power supply current levels of the LEDs.

It is to be noted that the current on the LED matrix may be chosen in a more accurate manner than that permitted by the resolution of the discrete levels by an auxiliary resistor 70 in parallel with the matrix. The current absorbed by such auxiliary resistor is subtracted from the LED matrix current, permitting more accurate regulation. The invention may also be applied to driver circuits of light sources other than current-regulated as described above. For example, the teaching of the present invention may be applied to the so-called LED and resistors driver circuit in which the driver current of the light sources is imposed only on the basis of the bin resistor value according to the Ohm law and not also by a regulation circuit.

In this circuit, the value of the bin resistor is chosen depending, as well as on the nominal power supply voltage, on the luminous flow selection and on the voltage selection of the LED lots. For example, generally there are three luminous flow levels and four voltage levels. Consequently, a bin resistor chosen from twelve resistor values is mounted on the lighting terminal strip. Given that, in an LED and resistor circuit of the type described above, there is no feedback which could cause instability and the voltage drop on the bin resistor is such as to allow electromagnetic disturbances to be ignored, and given that the bin resistor being of a high value compared to the case of a current-regulated circuit, the LED and resistor circuit does not suffer from variations of paracitic resistive components caused by the connectors between the electric control board unit and the LED terminal strip, then there is no reason for applying the invention to this type of circuit. However, the invention proves advantageous in the case where there is a design requirement to scale the LED terminal strip to a very small size. In this case, the problem of moving the bin resistor arises, the power of which must be dissipated on the electronic control unit circuit board. Without the teaching of the present invention when applied to the LED and resistor circuit, the same number of circuit boards of the electronic control unit would be needed as the number of bin resistors.

Figure 6:
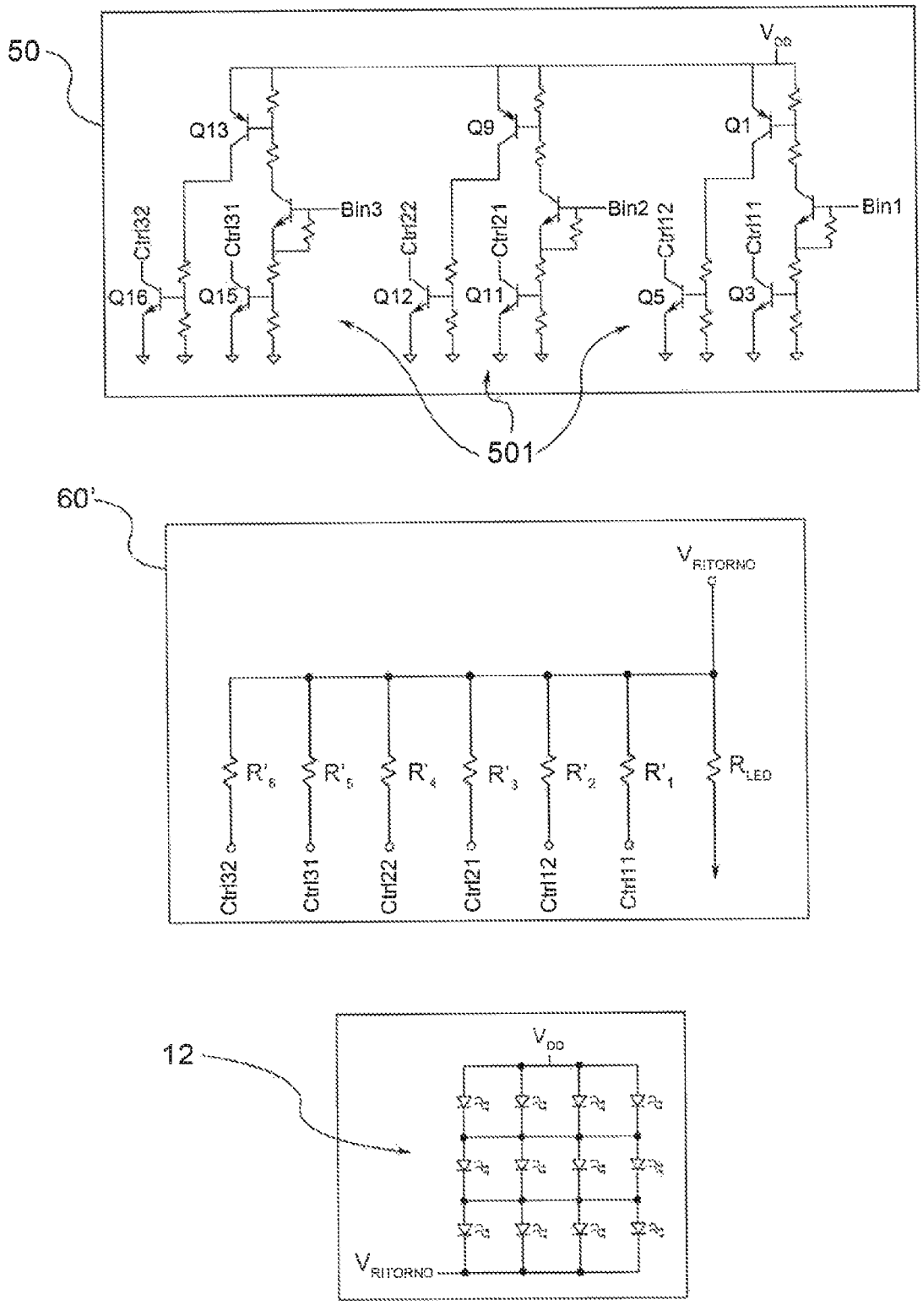
FIG. 6 is a circuit diagram of the driver circuit according to another embodiment of the invention.

In FIG. 6 an example of a 27-levels driver circuit of the LED and resistors type is shown in schematic form, corresponding to the driver circuit of the current regulated type described above with reference to FIG. 5. The LED terminal strip 10 includes, in addition to the LEDs 12, the same selection circuit 22 described above for the current regulated circuit. In the example shown, the selection circuit 22 includes three selection circuit elements Bin1, Bin2, Bin3. Each of these may assume, for example, the three levels mentioned above (short-circuit, open-circuit, or medium-impedance-circuit). Consequently, $3^3$=27 different combinations are possible of the input voltage to the electronic control unit 40. The latter, mounted for example on a respective electronic circuit board, separate from the LED terminal strip 10, includes the same levels acquisition circuit 50 described above for the current regulated circuit at 27 levels.

The electronic control unit 40 includes a modified levels definition circuit 60', which substitutes the levels definition circuit 60 of the current regulated circuit and the regulation circuit of the current 80. Such modified levels definition circuit 60' is connected to the LED string or matrix 12 and includes an LED resistor $R_{LED}$, connected for example between the LED string or matrix 12 and the ground and six levels definition resistors $R'_1$-$R'_6$, each having a terminal connected to a respective output terminal Ctrli of the levels acquisition circuit and the other terminal in common with a terminal of the LED resistor $R_{LED}$.

Consequently, depending on the status of the control signals Ctrli, for example if in high impedance or grounded, the resistor determining the driver current of the LED string or matrix 12 will have a value given either by the LED resistor $R_{LED}$, in the case in which all the control signals Ctrli are in high impedance, or by the parallel between the LED resistor $R_{LED}$ and the levels definition resistors R: the control signals Ctrli of which are connected to ground. Thus, a single control unit circuit board 40 mounts the same resistors circuit (60') which can assume different resistor levels for the LED string or matrix 12. The LED terminal strip 10, without the resistors, can be made of much smaller dimensions.

Figure 7:
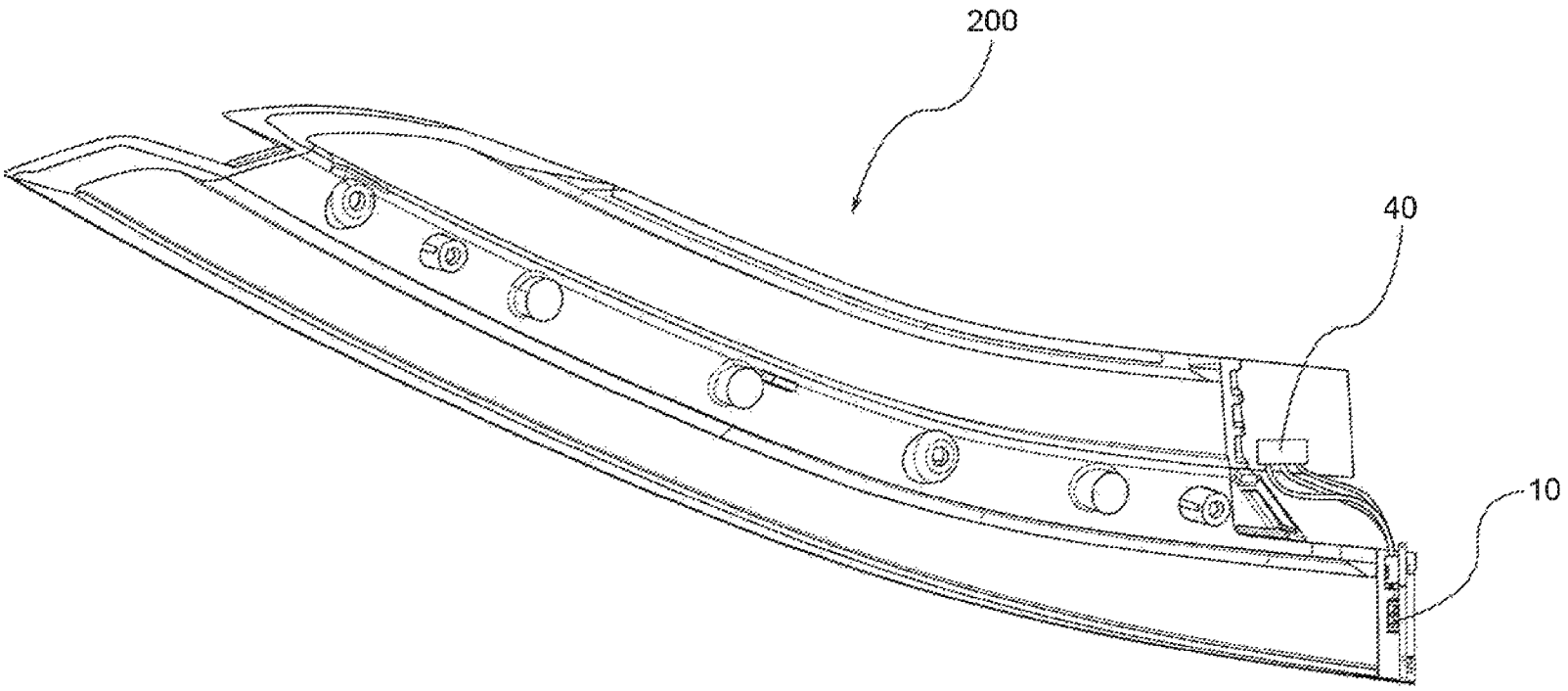
FIG. 7 illustrates an example of a vehicle light incorporating the driver circuit according to the invention.

With reference to FIG. 7, showing the main components of a vehicle light, the present invention also relates to a vehicle light 200 in which at least one light of the vehicle light is made with LED light sources driven by the driver circuit described above. In particular, as illustrated in FIG. 7, the lighting terminal strip 10 and the electronic control unit 40, separate from each other. The vehicle light 200 may be a front, rear, or a third brake light of the vehicle and, for example, a light of the rear light may be a sidelight, brake light, fog light, or similar.

A person skilled in the art may make modifications and adaptations to the embodiments of the driver circuit according to the invention, replacing elements with others functionally equivalent so as to satisfy contingent requirements while remaining within the sphere of protection of the following claims. For example, the electronic control unit may be implemented in software mode, for example, using a micro controller processing unit or a DSP to make the levels definition and acquisition circuits. For example, a conventional electronic control unit, made with discrete components as in the example illustrated, may be replaced by an LED integrated power driver, in itself known, and it will be clear to a person skilled in the art how to adapt the decoder block of the invention to the LED integrated power driver so as to vary the electric reference quantity of the driver which defines the LED driver current.

What is claimed is:

1. A driver circuit of light sources, in particular LEDs, comprising:

a selection circuit including a resistive selection element having a terminal connected to the power supply voltage and having an electric resistor level corresponding to a short-circuit, an open circuit or a medium impedance;

an electronic control unit (ECU) including a reference circuit that provides a reference electric quantity, and a regulation circuit of the driver current that establishes a driver current of the light sources on the basis of said reference electric quantity, said reference circuit includes:

a levels acquisition circuit that acquires at least one electric selection signal associated with the electric resistor level of the resistive selection element and provides selection information relative to said level of electric resistance; and a levels definition circuit that receives said selection information and provides, in response to said selection information, the reference electric quantity from a plurality of predefined levels of electric reference quantity, wherein said levels acquisition circuit includes two level acquisition transistors, the on or off state of which depends on the resistor level of the selection resistor element, and two current-controlled output switches, each controlled by a respective level acquisition transistor and having an output terminal connected to the levels definition circuit.

2. The circuit as set forth in claim 1, wherein each output terminal can be connected to ground or is suitable to assume a high impedance level.

3. The circuit as set forth in to claim 1, wherein said levels acquisition circuit is connected between the power supply voltage and the ground and includes a first level acquisition transistor having the base connected to the selection circuit, the emitter connected, by a voltage divider, to the base of a second transistor, defining an output switch, the emitter of which is connected to ground and the collector of which represents an output terminal of the levels acquisition circuit the collector of the first transistor being connected, by a resistive divider, to the base of a third level acquisition transistor, the emitter of which is connected to the power supply voltage and the collector of which is connected, by a voltage divider, to the base of a fourth transistor, defining the second output switch, the emitter of said fourth transistor being connected to the ground, the collector of said fourth transistor being the second output terminal of the levels acquisition circuit.

4. The circuit as set forth in claim 1, wherein said reference electric quantity is a reference voltage ($V_{ref}$).

5. The circuit as set forth in claim 4, wherein the levels definition circuit includes an operational amplifier circuit, where said operational amplifier has an input terminal connected to the output terminal of a generator circuit of a regulated constant voltage, an output terminal which the reference voltage is present on, and a gain depending on the level of said selection information.

6. The circuit as set forth in claim 5, wherein each output terminal of the levels acquisition circuit is connected to an input resistance connected to the inverting input of said operational amplifier.

7. The circuit as set forth in claim 1, wherein the electronic control unit is placed on a control circuit board, and wherein the light sources and the selection circuit are placed on a lighting terminal strip separate from the circuit board.

8. The circuit as set forth in claim 1, wherein each level of resistance of the selection resistor is associated with a luminous flow level generated by light sources belonging to a lot of light sources, when powered with nominal voltage and/or current values.

9. An electronic control circuit board of light sources comprising:

an electronic control unit (ECU) including a reference circuit that provides a reference electric quantity, and a regulation circuit of the driver current that determines a driver current of the light sources on the basis of said reference electric quantity;

wherein said reference circuit further includes a levels acquisition circuit that acquires at least one electric selection signal and provides selection information relative to said level of electric quantity and a levels definition circuit that receives said selection information and provides, in response to said selection information, the reference electric quantity from a plurality of predefined levels of electric reference quantity; and wherein said levels acquisition circuit further includes two level acquisition transistors, the on or off state of which depends on the level of said electric selection signal, and two current-controlled output switches, each controlled by a respective level acquisition transistor and having an output terminal connected to the levels definition circuit.

10. The circuit board as set forth in claim 9, wherein said levels acquisition circuit has a number of output terminals depending on the number of levels which said electric selection signal may assume, each output terminal being connectable to ground or being suitable for assuming a level of high impedance depending on the level of the electric selection signal in input to the levels acquisition circuit.

11. The circuit board as set forth in claim 10, wherein said levels acquisition circuit is a transistor circuit connected between the power supply voltage and the ground and comprising a first level acquisition transistor having the base connected to the selection circuit, the emitter connected, by a voltage divider, to the base of a second transistor, defining an output switch, the emitter of which is connected to ground and the collector of which represents an output terminal of the levels acquisition circuit the collector of the first transistor being connected, by a resistive divider, to the base of a third level acquisition transistor, the emitter of which is connected to the power supply voltage and the collector of which is connected, by a voltage divider, to the base of a fourth transistor, defining the second output switch, the emitter of said fourth transistor being connected to the ground, the collector of said fourth transistor being the second output terminal of the levels acquisition circuit.

12. The electronic control circuit board as set forth in claim 9, wherein the reference electric quantity is a reference voltage ($V_{ref}$) and wherein the levels definition circuit includes an operational amplifier circuit, where said operational amplifier has an input terminal connected to the output terminal of a generator circuit of a regulated constant voltage, an output terminal which the reference voltage is present on, and a gain depending on the level of said selection information.

13. The circuit board as set forth in to claim 12, wherein each output terminal of the levels acquisition circuit is connected to an input resistance connected to the inverting input of said operational amplifier.

14. A driver method of light sources, in particular LED, by an electronic control unit (ECU) that includes a reference circuit that provides a reference electric quantity, and a regulation circuit of the driver current that determines a driver current of the light sources on the basis of said reference electric quantity, said driver method comprising the steps of:

associating at least one selection circuit element to the light sources defined by an electric quantity having one of a plurality of pre-established electric quantity levels;

acquiring at least one electric selection signal associated with the level of said electric quantity of the selection circuit element and providing selection information relative to said level of electric quantity; and receiving said selection information and providing the reference electric quantity from a plurality of predefined levels of electric reference quantity in response to said selection information.

15. The method as set forth in claim 14, wherein said reference circuit generates a plurality of control signals the combination of which permits a plurality of states to be obtained corresponding to the plurality of levels which the selection electric quantity may assume.

16. The method as set forth in claim 15, wherein said plurality of control signals is used to obtain a corresponding plurality of gain levels of an operational amplifier having an input connected to a regulated voltage, a plurality of different reference voltage levels being obtainable from said operational amplifier depending on said plurality of gain levels.

* * * * *